US005356131A

United States Patent [19]

Mauro

[11] Patent Number: 5,356,131

[45] Date of Patent: Oct. 18, 1994

[54] APPARATUS FOR TRANSFERRING PAPER NAPKINS OR SIMILAR PRODUCTS FROM THE PRODUCTION MACHINE TO STACKER MEANS

[75] Inventor: Ghilardi Mauro, Lucca, Italy

[73] Assignee: Fabio Perini S.p.A., Lucca, Italy

[21] Appl. No.: 193,955

[22] Filed: Feb. 9, 1994

[30] Foreign Application Priority Data

Feb. 15, 1993 [IT] Italy ..... FI93 A 000025

[51] Int. Cl.[5] ..... B65H 39/10

[52] U.S. Cl. ..... 271/288; 271/296; 271/297; 271/305; 271/184; 271/180; 271/299; 271/300; 271/308

[58] Field of Search ..... 271/184, 185, 177, 180, 271/299, 300, 303, 306, 307, 308, 287, 288, 296, 297, 305

[56] References Cited

U.S. PATENT DOCUMENTS

| | | | |
|---|---|---|---|
| 3,227,275 | 1/1966 | Cody | 271/180 X |
| 3,305,233 | 2/1967 | Cody | 271/180 |
| 4,256,214 | 3/1981 | Back, Jr. | 271/300 X |
| 4,921,235 | 5/1990 | Biagiotti | 493/359 |
| 5,088,975 | 2/1992 | Ghilardi | 270/47 |
| 5,098,079 | 3/1992 | Sanborn, III | 271/308 X |

FOREIGN PATENT DOCUMENTS 076939 9/1982 European Pat. Off. .

*Primary Examiner*—H. Grant Skaggs
*Assistant Examiner*—Carol L. Druzbick
*Attorney, Agent, or Firm*—Francis J. Bouda

[57] ABSTRACT

The apparatus for transferring individual articles (M) in sheet form and placing them in stacks (P1, P2) of predetermined numbers includes a conveyor (17, 23) which picks up the articles from a delivery system (11) by gripping them along their edges. Along said conveyor at least two reciprocating expellers (27, 29) disposed in series remove said articles from the conveyor and lay them down onto a stacker device (31, 35; 33, 37). Each expeller (27, 29) operates with continuous, reciprocating motion at all times. The expeller (27) which is closest to the delivery system (11) may selectively be moved, in the direction of its reciprocating motion, so as to take a position (27X, 27Y) in the trajectory of the manufactured articles fed by said conveyor means, and, alternately, a position (27X', 27Y'), in which it is not in the article-feeding trajectory.

5 Claims, 8 Drawing Sheets

APPARATUS FOR TRANSFERRING PAPER NAPKINS OR SIMILAR PRODUCTS FROM THE PRODUCTION MACHINE TO STACKER MEANS

BACKGROUND OF THE INVENTION

The invention refers to an apparatus for transferring individual articles in sheet form and placing them in stacks of pre-determined numbers. It includes a conveyor which picks up said articles from a delivery system by gripping them along their edges. Along said conveyor, at least two reciprocating expellers remove said articles from the conveyor means and lay them down onto a stacker. The expellers are disposed in succession in the direction of advancement of said conveyor and caused to work alternately whereby, at selected times, the article fed to the expeller which is furthest away from the delivery system passes the temporarily inoperative expeller which lies closer to the delivery system.

In the production of paper napkins, especially the type double-folded along two folding lines perpendicular to the sides of the manufactured article, machines are well-known in the art wherein a web of paper material is longitudinally slit into strips which are then fed to transverse cutting and folding units. The finished article is withdrawn by a takeout cylinder, on which it has been folded, by a belt system which then conveys it to the expeller or extractor having reciprocating means to remove each individual folded article from the conveyor and lays it down where it becomes a part of a stack of articles. The expeller is programmed so that each stack contains a predetermined number of articles which must be moved away from the stacking region upon completion thereof. In order to operate the production machine continuously, without any slowing down or dwell, the prior art suggests the use of two symmetrical units for the withdrawal and stacking of the articles. The two units work alternately so that when one of them has completed a stack or pack, the subsequent articles are directed towards the other unit, thereby allowing the previously formed stack to be unloaded. Such machines are disclosed, for example, in the U.S. Pat. Nos. 5,088,975 and 4,921,235.

These known apparatuses are provided with two side-by-side rotating cylinders, each of which is associated with a respective belt conveyor with relevant expeller member. A selecting device diverts the articles coming from the production machine towards one or the other conveyor. This requires a considerably larger machine, and the use of a particularly delicate diverting mechanism which is subject to malfunctions.

European patent No. 076,939 shows an apparatus of the above-mentioned type, which has some of the features of this invention. In such apparatus, provision is made for a single conveyor system for the folded articles to which two expellers or extractors are combined, and which operate alternately. When the expeller or extractor member which is closest to the article-delivery region is not operating (i.e., when the folded article is to be conveyed directly to the second expeller), the first expeller is blocked in a withdrawn position relative to the trajectory of the folded article. Such system, therefore, requires means which are able temporarily to stop the reciprocating motion of at least one of the two extractors. In addition to the disadvantage of needing auxiliary means for stopping the motion, which must intervene at a very high speed, this prior device is unable to reach high production rates, because it requires some time for the activation and deactivation of one of the expellers or extractors. The time required for this operation is the elapsed time between the movement of successive articles along the conveyor means.

DESCRIPTION OF THE INVENTION

A first object of the present invention is to provide an apparatus of the above-mentioned type, which is of particularly simple and reliable construction.

A further object of the present invention is to provide an apparatus for the extremely high speed transfer of folded articles, thus enabling it to be associated to an extremely fast production machine.

These and other objects and advantages, which will become evident to those skilled in the art, are accomplished through an apparatus characterized substantially in that each expeller operates with a continuous, reciprocating motion even when it is not removing the articles. The expeller which is closest to the delivery system can be displaced in the direction of its reciprocating working motion so as to alternately take up an operative position in which it acts upon the articles fed by said conveyor means and an inoperative position in which it is out of the trajectory of movement of the articles which thus can be fed to the next expeller member.

In this way, both expeller members are kept constantly in motion, even when not acting on the articles, and the activation and deactivation of the expeller member closest to the delivery system can be performed with higher rapidity.

In a particularly desirable embodiment, the expeller which is closest to the delivery system is operate by a shaft having an oscillation motion about its axis. The shaft is made up of two portions with a clutch disposed therebetween. Also provided are means to offset the mutual angular position of the two shaft portions. Such arrangement allows the first of the two portions to be kept in oscillating motion about its axis always with the same angular phase, while the second shaft portion may be caused to rotate about the axis of the shaft in such a way as to change the mutual angular position of the two shaft portions. If a pinion-rack or equivalent means are provided on the second shaft portion for the actuation of one of the two expellers, the angular displacement between the first and second portion causes a change in the average position about which the relevant expeller oscillates in its rectilinear reciprocating motion.

The clutch may, advantageously, be a friction clutch which permits a relative sliding of the two shaft portions linked by said clutch.

In one embodiment, one of the two shaft portions and, in particular, the one which is mechanically engaged to the expeller, has a disk thereon set at an angle to the shaft, which is provided with two teeth designed to cooperate with respective abutments. The abutments are so placed that, when one abutment cooperates with the relevant tooth, the other abutment does not interfere with the other tooth. In this way, by changing the position of the abutments for said teeth, it is possible to stop the disk and thus the shaft portion engaged thereto, thereby causing an angular slide of the two shaft portions due to the presence of the friction clutch.

DETAILED DESCRIPTION

The invention will be better understood by reading the description and the attached drawing, which shows a practical, not limiting embodiment of the same invention. In the drawing.

Figure 1:
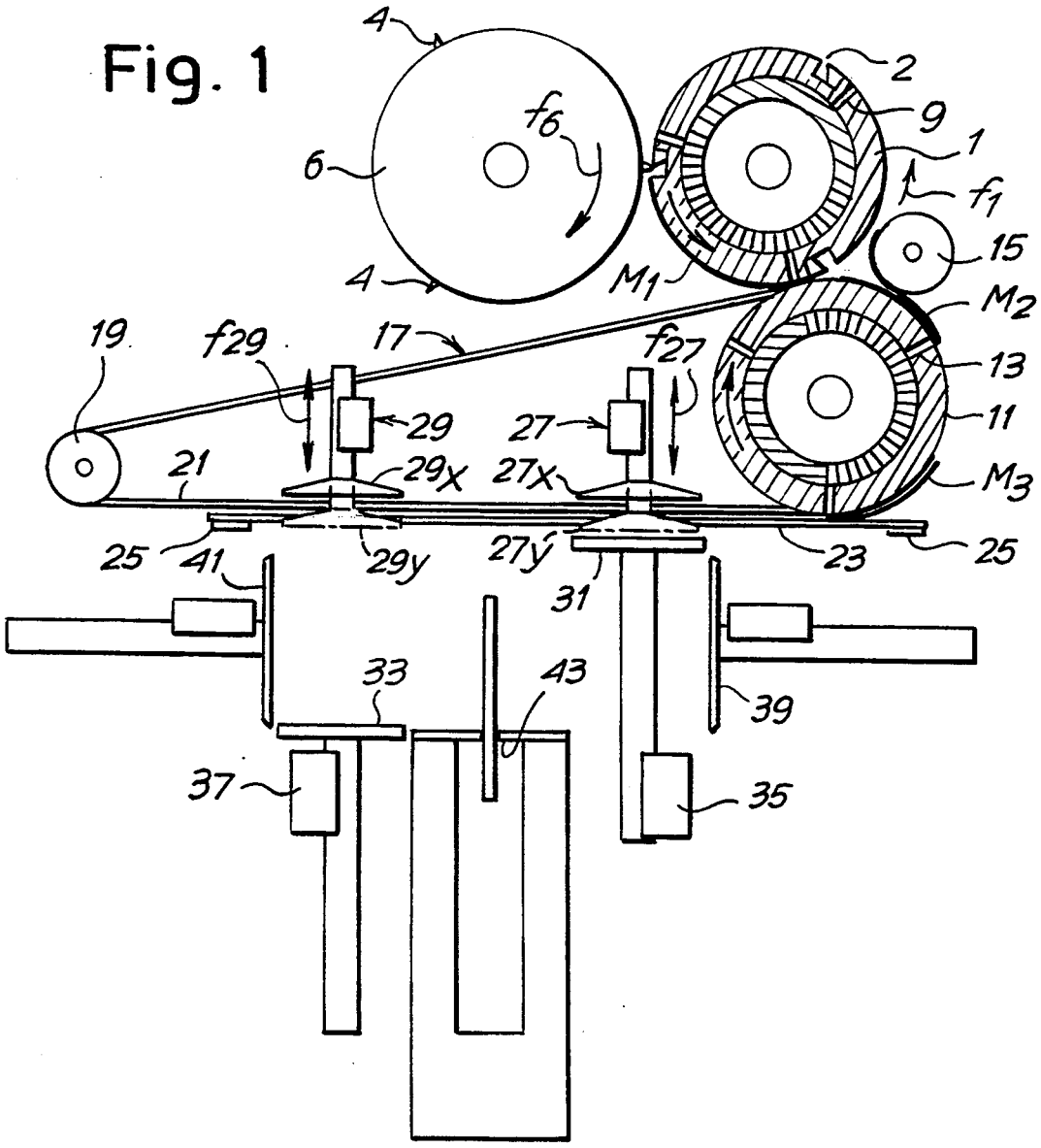
FIGS. 1 to 9 illustrate subsequent working steps of the apparatus according to the invention.

FIGS. 1 to 9 show a machine for the production of double-folded napkins. This machine includes a first cylinder 1 having three counter-blades 2 which cooperate with three corresponding blades 4 on a cutting cylinder 6. The directions of rotation of the cylinders 1 and 6, respectively, are shown by arrows f1 and f6.

Disposed upstream of the cylinders 1 and 6 are means (not shown) for slitting a web of paper to obtain a plurality of strips having twice the width as the final article, and means for longitudinally folding said strips to obtain a 2-ply web the width of the final article. The members of this slitter/folder are not described in detail as they are known, for example, from the above-mentioned U.S. Pat. Nos. 5,088,975 and 4,921,235.

The longitudinally folded 2-ply web or strip of paper is fed to the cylinder 1 where it is transversely cut by counter-blades 4 and blades 2, into individual items having the same width as the final article. Disposed close to each counter-blade 2 is a suction channel 9 which holds the item near its leading edge after cutting thereof. The rotation of the cylinder 1 causes the leading edge of the cut item to come in contact with a subsequent takeout cylinder 11 which is provided, like cylinder 1, with suction channels or holes 13. The position of the suction holes or channels 13 along the circumference of the cylinder 11 is offset with respect to the position of the analogous suction channels 9 on cylinder 1. In this way, in the region of shortest interspace between said cylinders, a channel 13 of the cylinder 11 will be almost midway between two adjacent suction channels 9 on the cylinder 1, i.e., in correspondence of a line along which the transverse folding of the item cut on the cylinder 1, is to be carried out. In this way, the transverse folding of the item and the transfer thereof onto the takeout cylinder 11 are obtained. A roller or bar 15 is provided to facilitate the transverse folding of the item during the transfer thereof from cylinder 1 to cylinder 11.

Passing around cylinder 11 are two small parallel belts having circular cross-section, only one of which is shown in FIGS. 1 to 9 and designated therein by 17. The small belts 17 pass around another roller 19 and are so arranged as to have a lower, almost horizontal, section 21 parallel to an adjacent belt 23 which is driven between two pulleys 25 having vertical axes. Alternatively, instead of two belts 17 and 23, a single belt may be used as disclosed, for example, in U.S. Pat. No. 5,088,975.

Associated to the conveyor made up of belts 17 and 23 are two expellers generally designated 27 and 29. Each of these expellers moves with a rectilinear reciprocating motion in vertical direction according to arrows f27 and f29, respectively. As will be described in greater detail later on, when a cut and folded napkin is fed from the cylinder 11 to the belt system 17 and 23, one or the other of the expellers Z7 and 29 pushes the napkin (by pulling the edges thereof from the belts 17 and 23) in order to lay said napkin down onto a corresponding plate 31 or 33, respectively.

Each plate 31 or 33 is vertically movable by means of an actuator schematically shown at 35 and 37, respectively, which may consist of a cylinder-piston member or pinion-rack system or another equivalent system. A pre-determined number of folded napkins are stacked on the movable plates 31, 33. Upon completion of a stack, a pusher 39 or 41, respectively, removes the stack of napkins from the respective plate 31 or 33 onto a central belt conveyor 43 which feeds the stacks of napkins towards a wrapping machine (not shown).

The operation of the apparatus as described, will be illustrated with reference to the steps shown in FIGS. 1 to 9. In the step shown in FIG. 1 three items indicated by M1, M2 and M3, respectively, are shown. The 2-ply item M1, which has just been cut to length by one of the blade-counterblade pairs 4, 2, is still fully flat on the periphery of the cylinder 1. The item M2 has been already removed by the cylinder 9 from cylinder 1 and folded transversely along its mid-line. The item M3, which has been folded along its mid-line is about to be handed over by cylinder 11 as a finished napkin to the conveyor means consisting of belts 17, 23.

Figure 2:
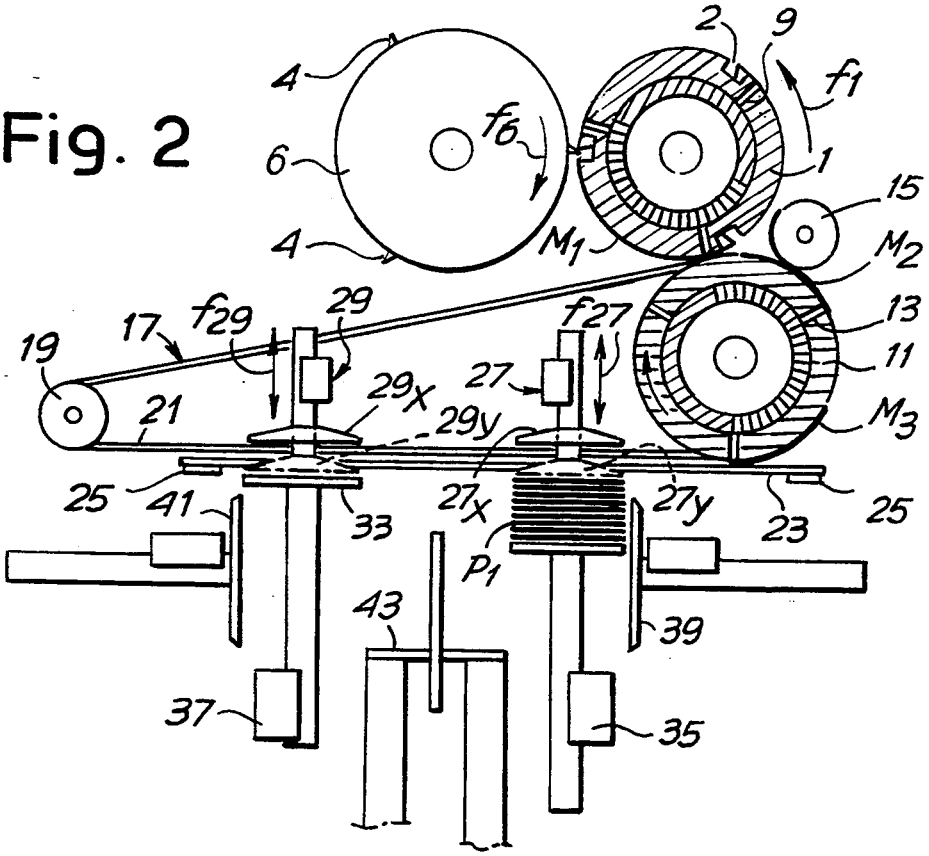

The expellers 27 and 29 are both moving with straight reciprocating motion in vertical direction between two end positions indicated by 27X, 27Y and 29X, 29Y, passing through the feeding trajectory of the napkins M along the conveyor 17, 23. Under these conditions, since the expeller 27 is the closest one to the delivery cylinder 11, all the napkins M coming from cylinder 11 are removed from the conveyor 17, 23 by the expeller 27 and stacked onto plate 31, to form a stack P1 as shown in Fig. 2. Up to this time, no napkin reaches or has been fed to expeller member 29.

Figure 3:
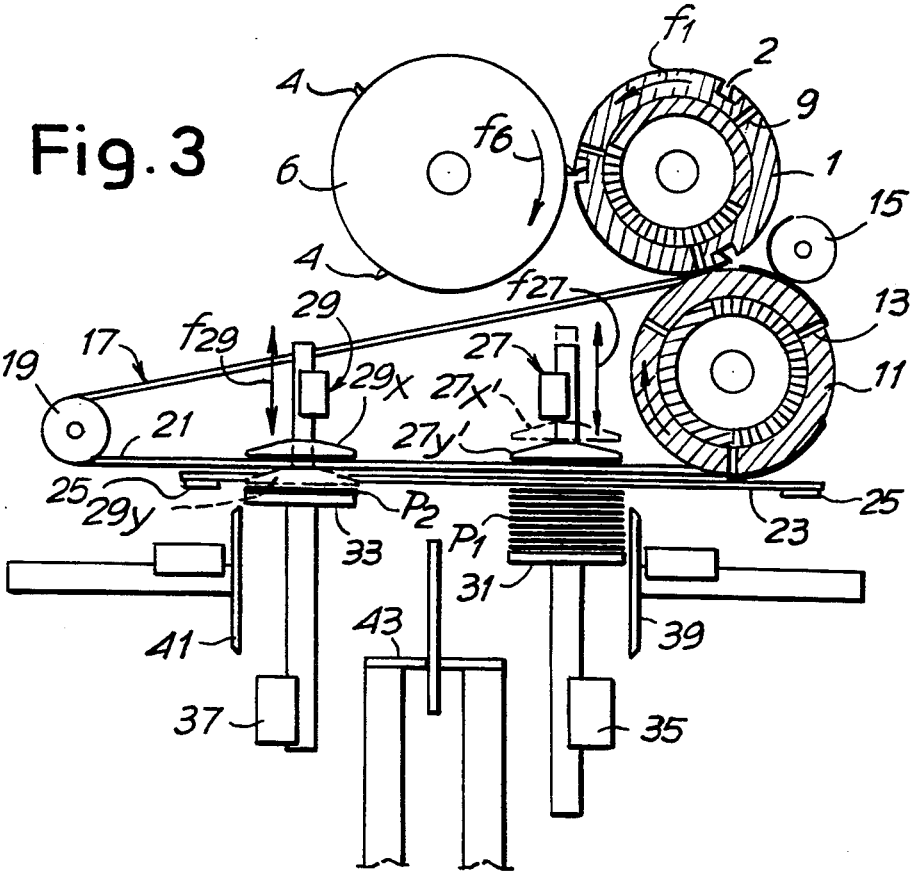

When the stack P1 on plate 31 has reached the preset number of napkins, it is necessary to stop the feeding to stack P1, and to begin to feed the expeller 29 and thus the plate 33, and to discharge from plate 31 the just-completed stack of napkins P1. FIG. 3 shows the initial stage of the formation of a stack P2 of napkins on plate 33. To allow the transit of the napkins past expeller member 27 so as to reach the expeller 29, the expeller 27 has been moved upwardly (with respect to the position shown in FIGS. 1 and 2) so that, even as it continues its reciprocating motion, it no longer moves low enough to meet the trajectory of the napkins, and thus does not remove any napkins from the conveyor 17, 23.

Figure 4:
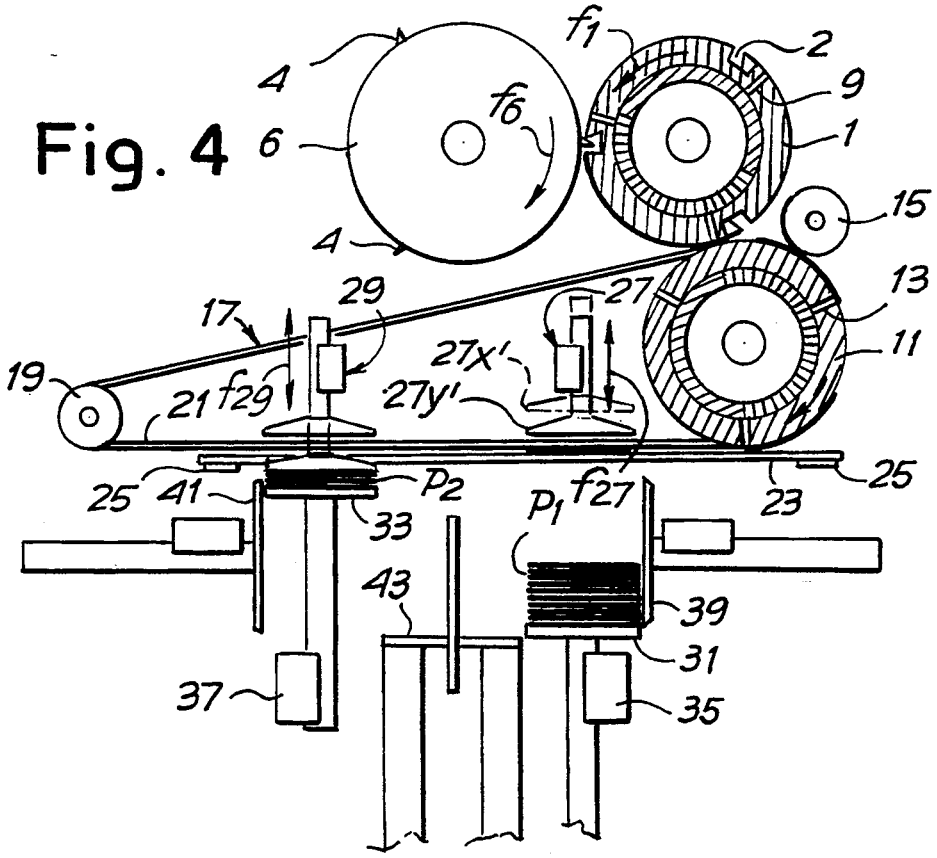
Figure 5:
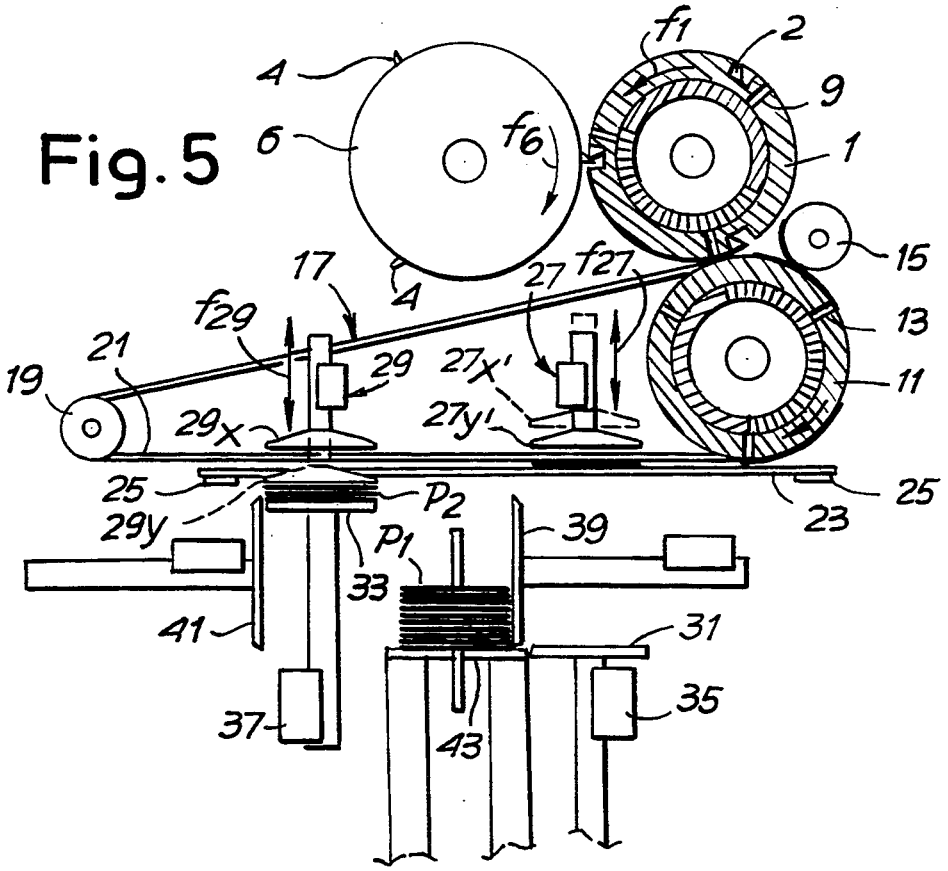
Figure 6:
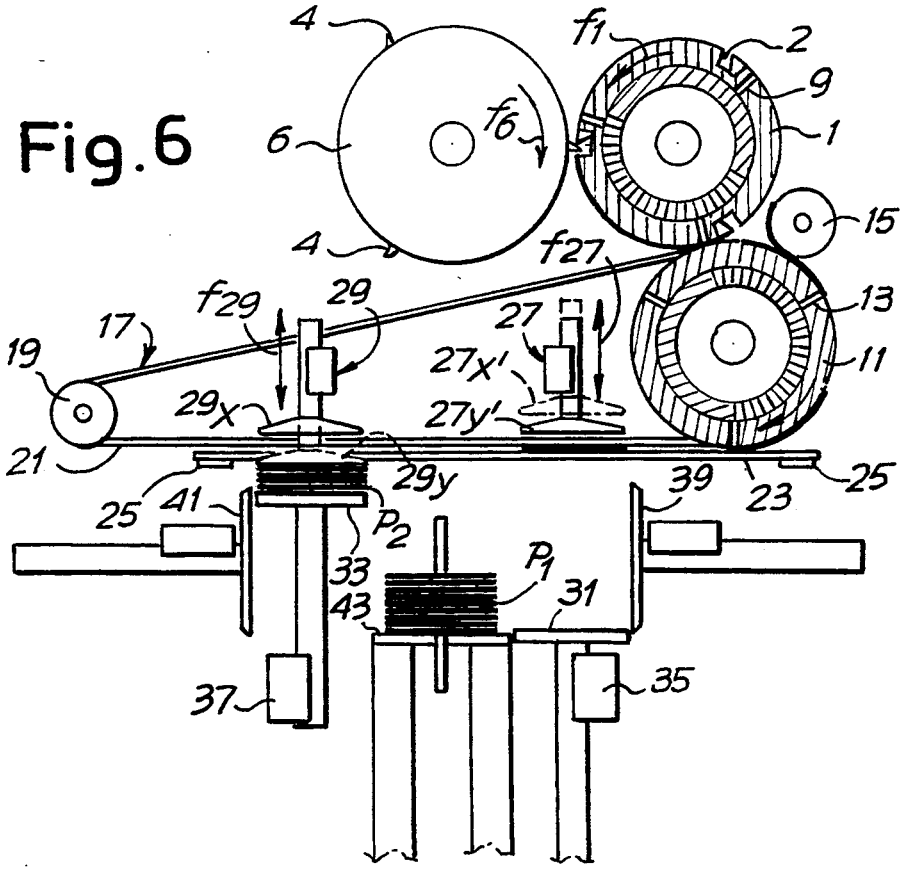

FIG. 4 shows an intermediate stage of the formation of stack P2, during which the previously formed stack P1 is unloaded from plate 31 onto belt conveyor 43 by pusher 39. FIG. 5 shows the stack P1 laid down on conveyor 43 ready to be transferred to the wrapping machine, while the stack P2 is still being formed.

Figure 7:
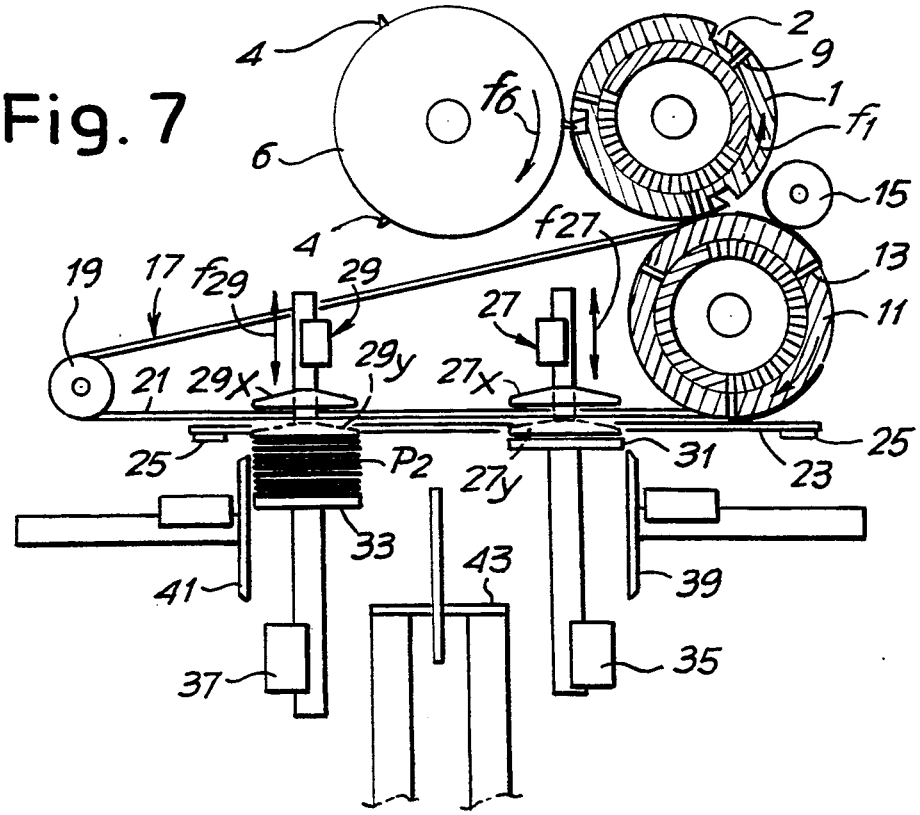

In FIG. 7, the stack P2 built up by the expeller 29 has been completed and the formation of a new stack on the plate 31 is started by the expeller 27 which has been moved downwards so as to pass through the feeding trajectory of the napkins M.

Figure 8:
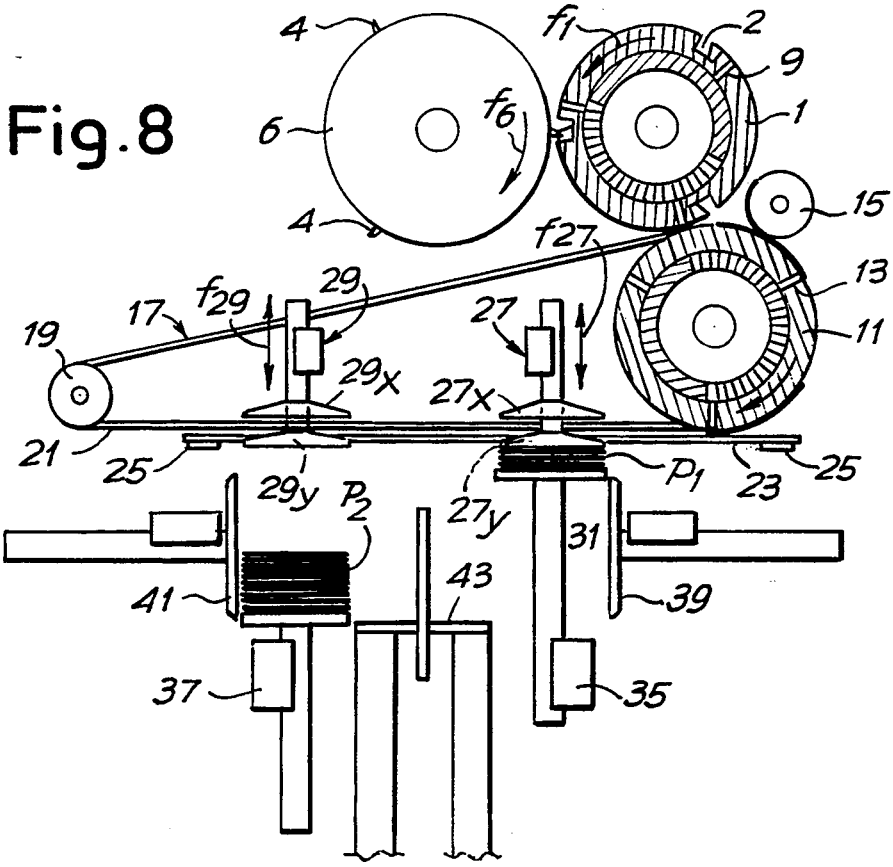
Figure 9:
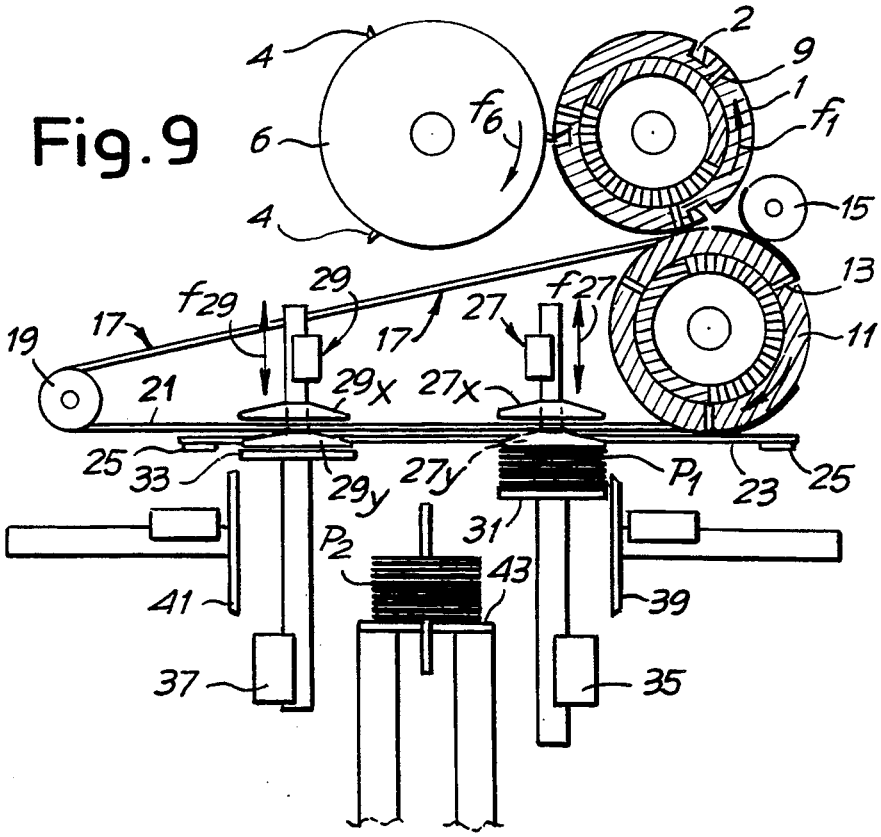

FIGS. 8 and 9 show successive steps during which the plate 33 is lowered and the stack P2 is unloaded onto belt conveyor 43, while a new stack P1 begins to form on plate 32.

Figure 10:
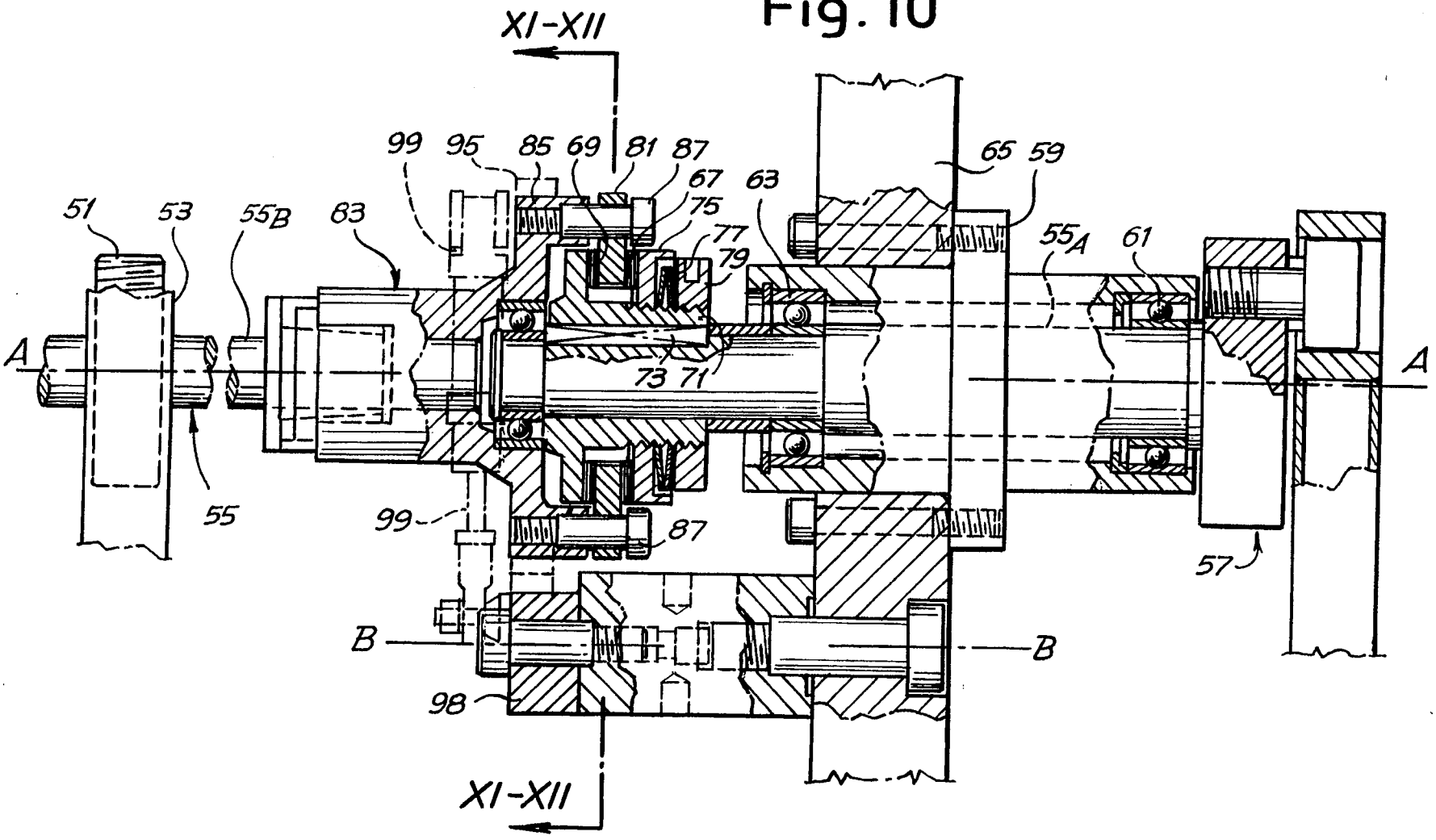
FIG. 10 shows a longitudinal section of the mechanism which allows the average position of oscillation of one of the expellers to be changed.
Figure 12:
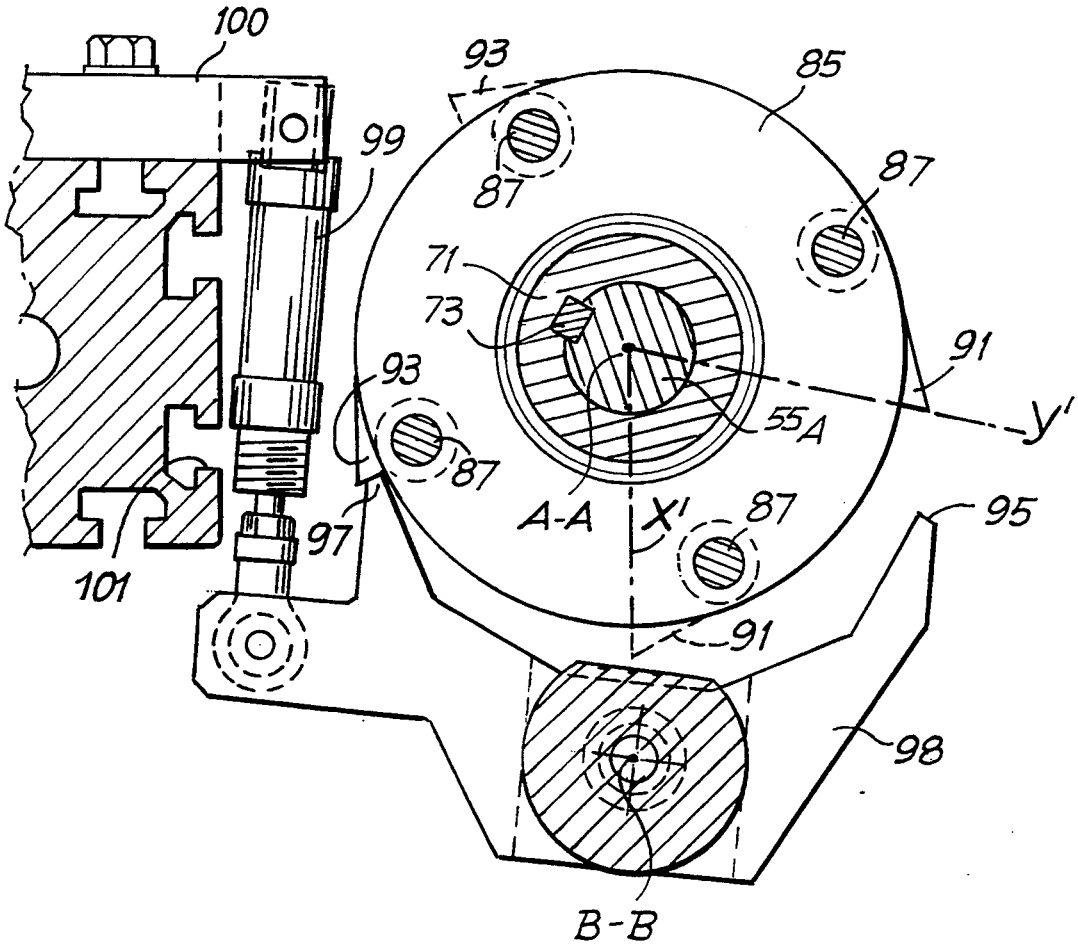

FIGS. 10 and 12 show in detail the operating features of expeller 27. The rectilinear reciprocating motion of the expeller 27 is obtained through a pinion-rack system schematically shown at 51 and 53 in FIG. 10. The pinion 51 is keyed on a driving shaft 55, made up of two portions 55A and 55B. The portion 55A is connected to a linkage 57 which transmits an oscillation motion to the shaft 55 about its longitudinal axis A—A. The portion 55A of the shaft 55 is supported within a sleeve 59 through bearings 61 and 63. The sleeve 59 is supported by the side panel 65 of the apparatus.

Mounted on the end of the shaft portion 55A opposite to the linkage 57 are two clutch disks 67, 69. The disk 69 is fixed to a bushing 71 which is connected to the shaft portion 55A through a key 73, while the clutch disk 67 is carried by a ring 75 which is resiliently urged against the disk 69 by a pair of cup-shaped springs 77 which react against an abutment formed by a ring nut 79. Disposed between the clutch disks 67, 69 is a ring 81 which is angularly engaged to a unit 83 which in turn angularly abuts one end of the portion 55B of the shaft 55. The unit 83 makes up a disk portion 85 to which the pivots 87 for the engagement of the ring 81 are fitted.

Figure 11:
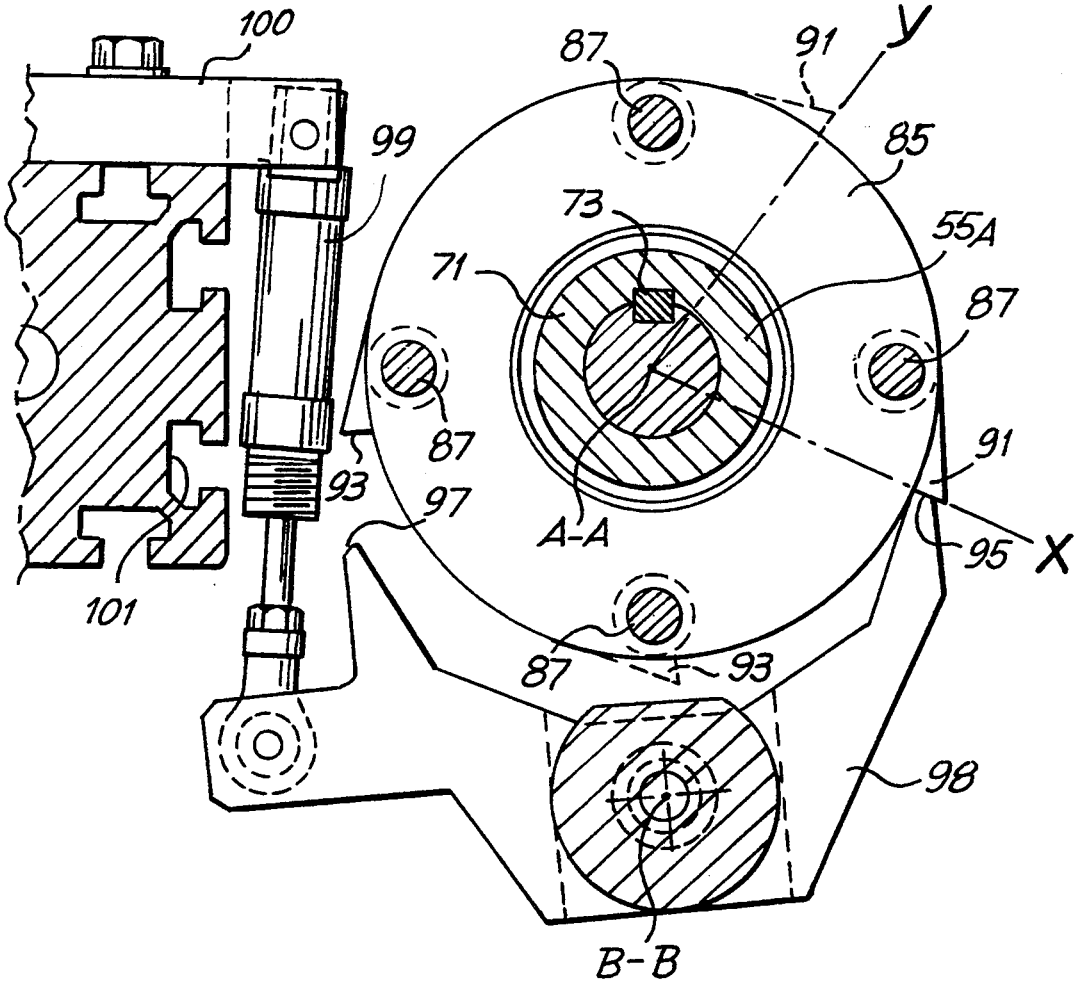
FIGS. 11 and 12 are sections on lines XI—XI and XII—XII of FIG. 10, illustrating the two mutual angular positions taken up by the shaft portions for the transmission of the motion to one of the two expeller members.

As can be seen, in particular in FIGS. 11 and 12, the disk 85 is provided with a pair of teeth 91 and 93. Said teeth cooperate with relevant abutments 95 and 97 formed on a rocker member 98 pivoting about an axis B—B and controlled by a cylinder-piston actuator 99 which is secured to a beam 101 through a bracket 100.

When the expeller 27 is in active position, i.e., in the position shown in FIGS. 1 and 2 and in FIGS. 7 to 9, the rocker 98 is in the angular position shown in FIG. 11. In this position, the disk 85 and the shaft 55 oscillate about the axis A—A between two angular positions designated X and Y in FIG. 11. The angular position Y of the disk 85 corresponds to the lower position 27Y of the expeller 27, while the angular position X corresponds to the position 27X of said expeller 27. In this movement, the tooth 93 can move angularly between the positions indicated with solid and dotted lines in FIG. 11 because the abutment 97 of the rocker 98 lies outside the trajectory of tooth 93.

When it is desired to move the expeller 27 upwards so that it does not interfere with the feeding trajectory of the folded napkins transferred by the conveyor 17, 23, and to allow said napkins to reach the expeller 29, it is sufficient (by means of the cylinder-piston actuator 99) to move the rocker 98 from the position of FIG. 11 to that of FIG. 12. In this way, the abutment 95 is moved out of the trajectory of the tooth 91, while the abutment 97 is brought to interfere with the tooth 93. This oscillation of the rocker 98 is carried out when the tooth 93 is moving upwards, i.e., when the disk 85 rotates in clockwise direction. In the subsequent counter-clockwise oscillation, the tooth 93 is no longer able to move to the position shown with dotted lines in FIG. 11 because it encounters, along its path, the abutment 97, further preventing the counter-clockwise oscillation of the disk 85 and thus of the shaft portion 55B. This causes a slippage of the friction clutch formed by the disks 67, 69, 81 and thus an angular offset of the portions 55A and 55B, respectively.

For the whole time during which the napkins must be fed to the expeller 29, the rocker 98 remains in the position of FIG. 12. In this way, the shaft portion 55B continues to oscillate between two angular positions indicated by X' and Y' in FIG. 12, which are offset with respect to the positions X and Y of FIG. 11.

The positions X' and Y' correspond to the positions 27X' and 27Y' (see FIG. 3) between which the rocker member 27 oscillates when it is in its inoperative position.

When the stack built up by the expeller 29 has been completed, the expeller 27 is brought back in its active position through a reverse oscillation of the rocker 98 from the position of FIG. 12 to the position of FIG. 11, which causes again a slippage of the friction clutch between the portions 55A and 55B enabling them to resume their original, mutual, angular position.

It will be appreciated that the apparatus so far described with reference to FIGS. 10 to 12 for the modification of the average position of the expeller 27 does not necessarily require it to be provided on the expeller member 29. The latter can be driven by a shaft having no friction clutch and oscillating about its axis with a motion in phase with the oscillation motion of the portion 55A of the shaft 55.

It is understood that the drawing shows an exemplification given only as a practical demonstration of the invention, as this may vary in the forms and dispositions without nevertheless coming out from the scope of the idea on which the same invention is based. The possible presence of reference numbers in the appended claims has the purpose of facilitating the reading of the claims, reference being made to the description and the drawing, and does not limit the scope of the protection represented by the claims.

Having thus described the invention, what is claimed as new and desired to protect by Letters Patent are the following:

1. An apparatus for transfer of single articles (M) in sheet form, such as paper napkins, and for stacking said articles in stacks (P1, P2) of a pre-determined number of articles, including:

a conveyor (17, 23) which picks up said articles from a delivery means (11);

at least two expellers (27, 29), disposed along said conveyor, and provided with reciprocating motion to remove said articles from the conveyor onto corresponding stacker means (31, 35; 33, 37);

the expellers (27, 29) being aligned in a direction of advancement of said conveyor and working alternately;

the articles which are fed to the expeller (29) which is further away from the delivery means (11) passing the expeller (27) which lies closer to the delivery means without being affected thereby;

characterized in that each expeller (27, 29) is provided with continuous, reciprocating motion even when it is not contacting any article, and further that the expeller (27) which is closest to the delivery means (11) may be moved in a direction of its reciprocating motion so as to alternately take up an operative position (27X, 27Y), in which it crosses a trajectory of advancement of the articles fed by said conveyor, and an inoperative position (27X',27Y'), in which it does not cross said trajectory of advancement of the articles.

2. An apparatus according to claim 1, characterized in that the expeller (27) closest to the delivery means (11) is operated by a shaft (55) which can oscillate about its axis (A—A), which shaft is formed by two portions (55A, 55B) between which a clutch (67, 69, 81) is disposed, and in that means (85, 98, 99) are provided to offset a mutual angular position of said two shaft portions.

3. An apparatus according to claim 2, characterized in that said clutch is a friction clutch which allows a mutual angular offset of the two portions (55A, 55B) of the shaft (55).

4. An apparatus according to claim 2 characterized in that one (55B) of said portions of the shaft (55) has a disk (85) angularly engaged thereon and which is provided with two teeth (91, 93) able to cooperate with respective abutments (95, 97), said abutments being disposed with respect to said disk (85) in such a way that, when a first abutment cooperates with one of said teeth, another abutment does not interfere with the other tooth.

5. An apparatus according to claim 4, characterized in that said two abutments (95, 97) are formed on a rocker member (98) oscillating about an axis (B—B) parallel to the axis (A—A) of the shaft (55).

* * * * *